US010139087B2

(12) United States Patent
Trottier et al.

(10) Patent No.: US 10,139,087 B2
(45) Date of Patent: Nov. 27, 2018

(54) LIGHTING DEVICE FOR AN AUTOMOTIVE VEHICLE AND ASSOCIATED ASSEMBLY METHOD

(71) Applicant: VALEO VISION, Bobigny (FR)

(72) Inventors: Samuel Trottier, Angers (FR); Jean-Christophe Thimouy, Petit-Mars (FR)

(73) Assignee: VALEO VISION, Bobigny (FR)

( * ) Notice: Subject to any disclaimer, the term of this patent is extended or adjusted under 35 U.S.C. 154(b) by 0 days.

(21) Appl. No.: 15/439,408

(22) Filed: Feb. 22, 2017

(65) Prior Publication Data

US 2017/0241625 A1 Aug. 24, 2017

(30) Foreign Application Priority Data

Feb. 23, 2016 (FR) ..... 16 51460

(51) Int. Cl.
*F21S 8/10* (2006.01)
*F21V 19/00* (2006.01)
(Continued)

(52) U.S. Cl.
CPC ..... *F21V 19/004* (2013.01); *F21S 41/141* (2018.01); *F21S 41/19* (2018.01); *F21S 41/192* (2018.01);
(Continued)

(58) Field of Classification Search
CPC ..... F21V 19/003; F21V 19/004; F21V 19/02; F21S 41/198; F21S 41/19; F21S 41/194;
(Continued)

(56) References Cited

U.S. PATENT DOCUMENTS

2006/0152940 A1 7/2006 Josquin et al.
2009/0296418 A1* 12/2009 Luo ..... F21K 9/00 362/516
(Continued)

FOREIGN PATENT DOCUMENTS

| | | | |
|---|---|---|---|
| DE | 10 2012 219 007 | A1 | 4/2014 |
| EP | 1 679 472 | A2 | 7/2006 |
| EP | 2 213 934 | A2 | 8/2010 |
| EP | 2 574 503 | A1 | 4/2013 |

OTHER PUBLICATIONS

French Preliminary Search Report dated Oct. 26, 2016 in Patent Application No. FR 1651460 (with English translation of Categories of Cited Documents).

*Primary Examiner* — Mary Ellen Bowman
(74) *Attorney, Agent, or Firm* — Oblon, McClelland, Maier & Neustadt, L.L.P.

(57) ABSTRACT

A lighting device for an automotive vehicle includes a printed circuit board having one or more electronic components, and a support joined, or capable of being joined, to the printed circuit board. The lighting device included a first joining device for joining the printed circuit board to the support, the first device permitting the printed circuit board to rotate, with respect to the support, about an axis and perpendicularly to the axis. Also included is second joining device for joining the printed circuit board to the support, located at a distance from the first joining device and capable of blocking the rotations of the printed circuit board with respect to the support, in an assembled configuration of the printed circuit board and the support.

15 Claims, 2 Drawing Sheets

(51) Int. Cl.

| | |
|---|---|
| ***F21V 19/02*** | (2006.01) |
| ***F21S 41/19*** | (2018.01) |
| ***F21S 41/141*** | (2018.01) |
| ***F21S 43/19*** | (2018.01) |
| ***F21S 43/14*** | (2018.01) |
| *F21Y 115/10* | (2016.01) |

(52) U.S. Cl.
CPC ..... *F21S 41/198* (2018.01); *F21S 43/14* (2018.01); *F21S 43/19* (2018.01); *F21S 43/195* (2018.01); *F21V 19/02* (2013.01); *F21Y 2115/10* (2016.08)

(58) Field of Classification Search
CPC ..... F21S 41/192; F21S 41/141; F21S 43/14; F21S 43/19; F21S 43/195
See application file for complete search history.

(56) References Cited

U.S. PATENT DOCUMENTS

| | | | | |
|---|---|---|---|---|
| 2010/0195345 | A1 | 8/2010 | Sugie | |
| 2010/0302777 | A1* | 12/2010 | Knoll | F21V 17/06 362/235 |
| 2013/0088766 | A1* | 4/2013 | Uken | B60K 35/00 359/267 |
| 2013/0135888 | A1 | 5/2013 | Le Bars et al. | |
| 2013/0141913 | A1* | 6/2013 | Sachsenweger | F21V 19/003 362/249.02 |
| 2014/0334162 | A1* | 11/2014 | Kwon | F21V 15/01 362/362 |
| 2017/0082257 | A1* | 3/2017 | Yoon | F21S 48/1122 |

* cited by examiner

LIGHTING DEVICE FOR AN AUTOMOTIVE VEHICLE AND ASSOCIATED ASSEMBLY METHOD

The present invention relates to a lighting device for an automotive vehicle, of the type comprising: a printed circuit board, comprising one or more electronic components; and a support joined, or capable of being joined, to the printed circuit board.

It is known practice to provide, at the back or on the sides of an automotive vehicle, lighting devices that are capable of fulfilling various illumination and signalling functions. A headlight comprising light-emitting diodes (LEDs) positioned on a printed circuit board (PCB), itself mounted on a support, is in particular known from the document CN203784789.

Mounting the PCB on the support is tricky due to the ergonomics of the parts. Specifically, impacts during assembly must be avoided so as not to damage the LEDs or, more generally, the electronic components of the PCB. For this reason, the mounting of the PCB on the support generally requires special tools and a technically restrictive method.

An aim of the present invention is to simplify the mounting of the lighting device, in particular the joining of the PCB to the support.

To this end, the present invention relates to a lighting device of the type mentioned above, comprising: a first joining device for joining the printed circuit board to the support, said first joining device comprising a first element borne by the printed circuit board and a second element borne by the support, said first device permitting said printed circuit board to rotate, with respect to said support, about an axis and perpendicularly to said axis; and a second joining device for joining the printed circuit board to the support, located at a distance from the first joining device, said second joining device comprising: a third element borne by the printed circuit board and located at a distance from the first element; and a fourth element borne by the support and located at a distance from the second element; said second joining device being capable of blocking the rotations of the printed circuit board with respect to the support, in an assembled configuration of said printed circuit board and said support.

According to other advantageous aspects of the invention, the lighting device comprises one or more of the following features, taken alone or in any technically possible combination:

- the first and second elements of the first joining device comprise, respectively: an opening made in the printed circuit board; and a relief of the support, said relief being positioned along the axis; the printed circuit board being capable of pivoting about said relief inserted into said opening;
- the third and fourth elements of the second joining device comprise, respectively: a cutout of an edge of the printed circuit board; and a notch of the support; said cutout being capable of being inserted into said notch;
- the printed circuit board is substantially longitudinal in form, comprising first and second opposite ends; the first element of the first joining device is located close to the first end; and the third element of the second joining device is located close to the second end;
- the printed circuit board and the support being in an angular position with respect to the axis, corresponding to the assembled configuration, the first joining device permits the printed circuit board to travel with respect to the support, perpendicularly to said axis, by an angle with respect to said assembled configuration, said angle being between 5° and 25° and preferably equal to about 20°;
- the respective shapes of the first and second elements of the first joining device are capable of dictating a spatial configuration of the printed circuit board with respect to the support when joining said first and second elements;
- the second joining device is configured to block the rotation of the printed circuit board with respect to the support about the axis in a first direction only; and the lighting device additionally comprises a third joining device between the printed circuit board and the support, configured to block the rotation of the printed circuit board with respect to the support about the axis in a second, opposite direction, said third joining device comprising a fifth element borne by the printed circuit board and a sixth element borne by the support;
- the lighting device comprises one or more light sources, preferably of semiconductor-based type, fixed to a face of the printed circuit board.

The invention additionally relates to a method of assembling a lighting device as described above, comprising the following steps: the first and second elements of the first joining device are joined to one another in an initial configuration of the printed circuit board with respect to the support; then first, second and third rotational movements are successively applied to the printed circuit board with respect to the support, the second movement being effected about the axis, the first and third movements being effected perpendicularly to said axis, a trajectory of the third element of the second joining device thus circumventing the fourth element of said second joining device; then a fourth rotational movement is applied to the printed circuit board with respect to the support, about the axis, in the opposite direction to the second movement, so as to join the third and fourth elements of the second joining device, the printed circuit board and the support thus being in the assembled configuration.

According to other advantageous aspects of the invention, the assembly method comprises one or more of the following features, taken alone or in any technically possible combination:

- the application of the first and second rotational movements to the printed circuit board leads to an elastic deformation of the sixth element of the third joining device; and the application of the third and fourth rotational movements to the printed circuit board subsequently leads to an opposite deformation of said sixth element, and to the joining of the fifth and sixth elements of the third joining device;
- the sixth element of the third joining device is joined to the support after the joining of the third and fourth elements of the second joining device.

The invention will be better understood on reading the following description, which is provided solely by way of non-limiting example and written with reference to the appended drawings, in which:

FIGS. 1, 2 and 3 show a lighting device 10 according to one embodiment of the invention.

The lighting device 10 comprises a printed circuit board, or PCB, 12 and a support 14, joined, or capable of being joined, to one another.

Figure 1:
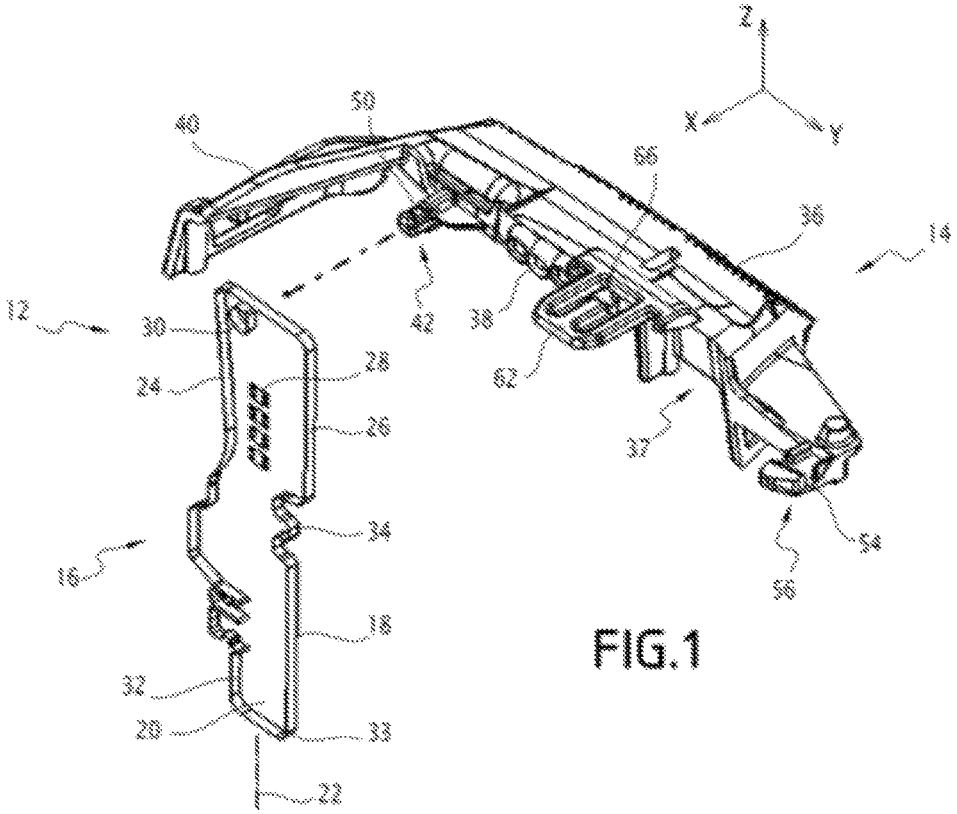
FIG. 1 is a perspective view of a lighting device according to one embodiment of the invention, in a configuration before assembly.
Figure 3:
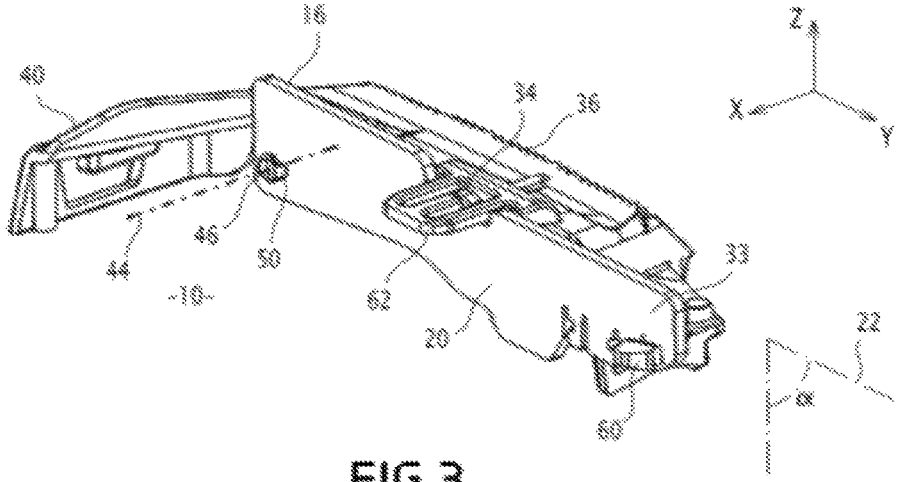
FIG. 3 is a perspective view of the lighting device of FIGS. 1 and 2, in an assembled configuration.
Figure 2:
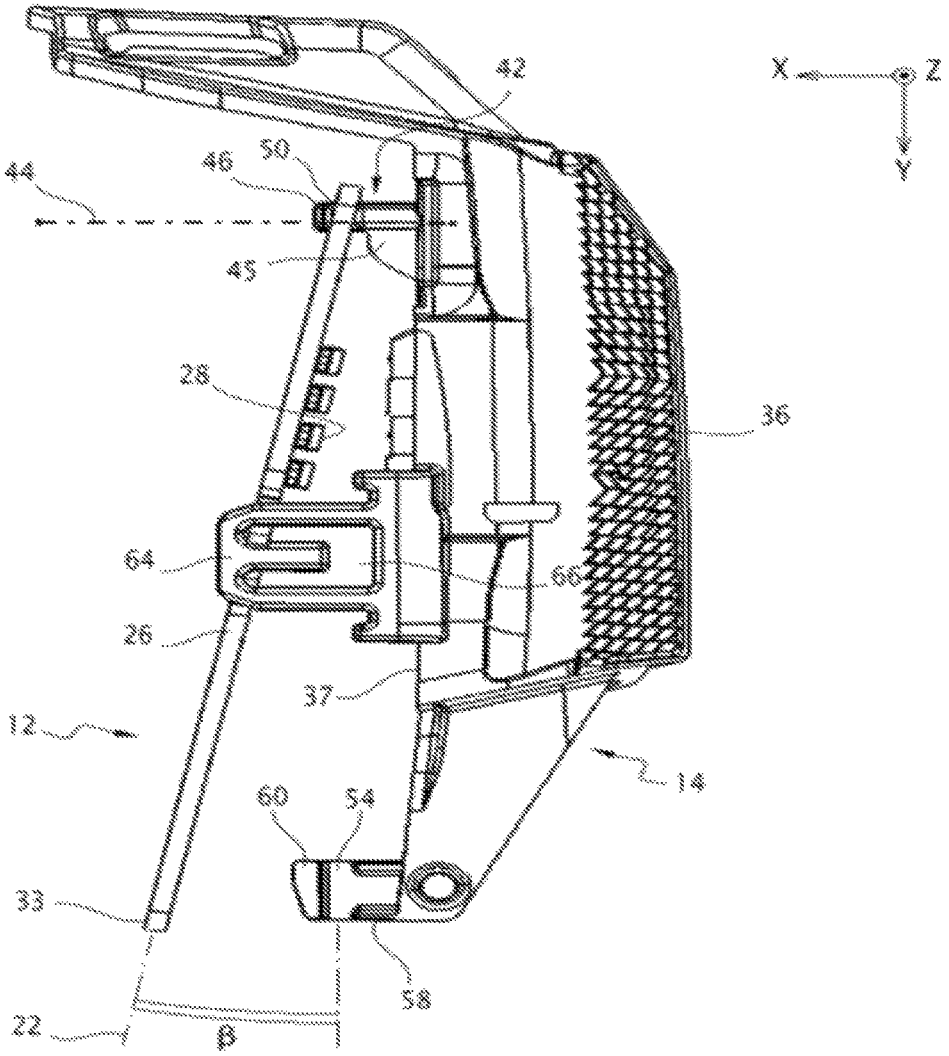
FIG. 2 is a view from above of the lighting device of FIG. 1, in a configuration during assembly.

The PCB 12 comprises a rigid substrate board 16 on which an electrically conductive material is deposited, forming an electrical circuit. The board 16 is substantially planar and comprises first 18 and second 20 opposite faces. In the embodiment of FIGS. 1 to 3, the board 16 is essentially longitudinal in form, positioned along a first axis 22. In particular, the board 16 comprises first 24 and second 26 longitudinal edges, located on either side of the first axis 22.

The PCB 12 also comprises electronic components 28, fixed to the first face 18 of the board 16.

In the embodiment of FIGS. 1 to 3, said components comprise, in particular, light sources 28 of LED type, which can be seen in FIG. 2 and, by making the PCB transparent, in FIG. 1.

According to one variant (not shown), the lighting device 10 comprises at least one light source fixed to the support 14 and/or to another element, of heat sink type. In this case, said light source is for example electrically connected to the PCB 12 via a flexible printed circuit board before or after the PCB 12 is joined to the support 14.

The PCB 12 also comprises joining elements for joining to the support 14. In the embodiment of FIGS. 1 to 3, said joining elements are formed from cutouts in the board 16.

A first joining element is formed from a through-hole 30, close to a first end of the board 16 along the axis 22. Preferably, the through-hole 30 is asymmetrical in form along a plane parallel to the axis 22 and perpendicular to the first 18 and second 20 faces. In the embodiment of FIGS. 1 to 3, the through-hole 30 takes the form of a half-moon, with one curved edge and one rectilinear edge positioned on the side of the first 24 and the second 26 longitudinal edges of the board 16, respectively.

A second joining element is formed from a first cutout 32 made in the first longitudinal edge 24 of the board 16. The first cutout 32 is close to a second end 33 of the board 16 along the axis 22.

A third joining element is formed from a second cutout 34 made in the second longitudinal edge 26 of the board 16. The second cutout 34 is located between the through-hole 30 and the first cutout 32 along the axis 22.

The support 14 is for example formed from one or more plastic materials. The support 14 comprises for example an output optical system 36, intended to form part of an outer surface of an automotive vehicle comprising the lighting device 10.

The support 14 also comprises a contact portion 37, adjacent to the output optical system 36. Said contact portion 37 is intended to make contact with the PCB 12 when said PCB is joined to the support 14, as in FIG. 3. Housings 38 are made in said contact portion 37, which housings are intended to be positioned facing the LEDs 28 of the PCB 12. Between said housings 38 and the output optical system 36, the support 14 potentially comprises additional optical devices and/or light guides (not shown), intended to transmit and release light emitted by the LEDs 28 to the exterior of the lighting device 10.

The support 14 also comprises structural elements 40, intended to join said support 14 to the automotive vehicle. These structural elements, as well as potential parts that are already joined to the support 14, form a spatial footprint when mounting the PCB 12 on the support 14.

Throughout the rest of the description, reference is made to an orthonormal coordinate system (X, Y, Z) defined with respect to the support 14. In the lighting device 10 in the assembled configuration, as shown in FIG. 3, a main direction of emission of the light from the LEDs 28 is parallel to X. The direction Z corresponds to the vertical, the lighting device 10 being mounted on an automotive vehicle.

The support 14 also comprises joining elements for joining to the PCB 12 such that, in the assembled configuration (FIG. 3), the board 16 is substantially positioned against the contact portion 37 along a plane (Y, Z), the first axis 22 being positioned along Y.

A first joining element for joining the support 14 to the PCB 12 is formed from a pivot rod 42. In particular, the pivot rod 42 is intended to be joined to the through-hole 30 of the PCB 12 and to interact with said through-hole.

The pivot rod 42 is substantially longitudinal in form, positioned along a second axis 44 parallel to X. The pivot rod 42 forms a protrusion with respect to the contact portion 37 of the support 14. Said protrusion is oriented toward the rear, i.e. in the opposite direction to the output optical system 36.

A first end of the pivot rod 42, connected to the contact portion 37, is formed from an axial abutment 45. A second, free end of said pivot rod 42 is formed from an insertion knob 46.

In FIG. 1, the PCB 12 is in a configuration for slotting the insertion knob 46 into the through-hole 30, allowing the pivot rod 42 to be inserted into the PCB 12. In this insertion configuration, the board 16 is substantially positioned so as to be perpendicular to the second axis 44. The first face 18 of said board 16 is oriented toward the contact portion 37 of the support 14, i.e. toward the front in the figures.

In the insertion configuration, the first axis 22 forms an angle $\alpha$ (FIG. 3) with the position of said axis 22 in the assembled configuration. Preferably, the angle $\alpha$ is larger than or equal to 45°.

In the embodiment of FIGS. 1 to 3, the angle $\alpha$ is substantially equal to 90°. In the insertion configuration, the first axis 22 is positioned along Z and the second end 33 of the board 16 is oriented downward.

A cross section of said insertion knob 46 takes a form that is substantially complementary to that of the through-hole 30 of the PCB 12, in said insertion configuration. However, when the axis 22 of the board 16 is inclined with respect to its vertical position in FIG. 1, the form of the insertion knob 46 is no longer complementary to that of the through-hole 30. The insertion knob 46 then forms an abutment preventing the PCB 12 being separated from the pivot rod 42 by translation along the axis 44.

In the embodiment of FIGS. 1 to 3, the insertion knob 46 of the support 14 takes the form of a half-moon, symmetrical along a plane (X, Y).

Between the axial abutment 45 and the insertion knob 46, the pivot rod 42 comprises a rotational portion 50. An axial length of the rotational portion 50 grants the PCB 12 freedom of translation along the axis 44, between the abutments 45 and 46.

Furthermore, the transverse dimensions of the rotational portion 50 are smaller than those of the insertion knob 46. In particular, when the rotational portion 50 is inserted into the through-hole 30 of the PCB 12, said PCB 12 is capable of pivoting about the second axis 44 parallel to X.

Additionally, the form and the dimensions of the through-hole 30 and of the pivot rod 42 allow the PCB 12, placed on the rotational portion 50, to pivot about at least one axis perpendicular to the second axis 44. In the embodiment of FIGS. 1 to 3, the PCB 12, placed on the rotational portion 50, may pivot about any axis in a plane (Y, Z) passing through the rotational portion 50.

In particular, the PCB 12, placed on the rotational portion 50, may pivot perpendicularly to X so as to move the second end 33 of the board 16 toward the rear.

The form of the first joining elements allows the rotational movements of the PCB 12, about X and perpendicularly to X, to take place simultaneously or separately. The amplitude of rotation of the PCB 12 about an axis perpendicular to X depends on an angular position of said PCB 12 with respect to X.

In FIG. 2, the PCB 12 is shown in an intermediate assembly configuration, the first axis 22 being positioned in the same plane (X, Y) as in the assembled configuration of FIG. 3. In this intermediate assembly configuration, the first axis 22 is capable of forming a maximum angle β with the position of said axis 22 in the assembled configuration. The maximum angle β corresponds to a maximum travel toward the rear of the second end 33 of the board 16 with respect to the contact portion 37.

Preferably, the maximum angle β is between 5° and 25°, more preferably equal to about 20°.

A second joining element for joining the support 14 to the PCB 12 is formed from a notch 54 capable of being joined to the first cutout 32 of said PCB 12.

The notch 54 extends substantially along Y and is made in a bracket 56 connected to the contact portion 37 of the support 14. The bracket 56 is substantially positioned along X and oriented toward the rear.

Along X, the notch 54 is delimited on the one hand by an abutment 58 oriented toward the contact portion 37 and, on the other hand, by a bulge 60 forming a free end of the bracket 56. Along Z, the notch 54 is made in an upper portion of the bracket 56.

In the assembled configuration of FIG. 3, the first cutout 32 of the PCB 12 is inserted into the notch 54. The rotation of the board 16 about the second axis 44 is thus blocked in the direction of downward movement of the second end 33 of said board 16.

A third joining element for joining the support 14 to the PCB 12 allows the board 16 to be blocked in the opposite direction of rotation, by interacting with the second cutout 34 of said PCB 12.

Said third joining element is formed from a tab 62, in relief along X with respect to the contact portion 37 of the support 14 and oriented toward the rear. The tab 62 comprises in particular a free end 64 along X.

A lower portion of said tab 62 comprises a cavity 66, positioned away from the free end 64. Said cavity 66 takes a form that is complementary to that of the second cutout 34, so as to block the rotation and translation of the board 16 along the second axis 44.

In the embodiment of FIGS. 1 to 3, the tab 62 is flexible and capable of being elastically deformed through twisting about an axis parallel to Y; moreover, the cavity 66 passes all the way through along Z.

According to one variant (not shown), the tab 62 is fixed to the contact portion 37 at the end of the assembly method of joining the support 14 to the PCB 12. According to this variant, the tab 62 may be rigid and/or the cavity 66 may not pass all the way through.

A method of assembling the lighting device 10 will now be described. With respect to the support 14, the PCB 12 is placed in the insertion configuration shown in FIG. 1. The pivot rod 42 is subsequently inserted into the through-hole 30 of the board 16.

The particular forms of the through-hole 30 and of the insertion knob 46 fulfill a poka-yoke function, such that the LEDs 28 are necessarily oriented toward the contact portion 37 of the support 14.

The PCB 12 is translated along the second axis 44 until being blocked by the axial abutment 45 of the pivot rod 42. The through-hole 30 is then positioned about the rotational portion 50 of said pivot rod 42.

A first rotational movement is then applied to the PCB 12 so as to move the second end 33 of the board 16 toward the rear. The first rotational movement takes place about an axis perpendicular to X.

Simultaneously or subsequent to said first movement, a second rotational movement is applied to the PCB 12 about the second axis 44, so as to move the second end 33 of the board 16 upward. The PCB 12 is thus in the intermediate assembly configuration of FIG. 2. The angle of travel toward the rear allows said second end 33 to pass clear of the bulge 60 while the second rotational movement occurs. The board 16 therefore does not abut against the bracket 56 during said second movement.

The second rotational movement about the axis 44 is continued until the second cutout 32 is located higher than the bracket 56 with respect to Z.

A third rotational movement is then applied to the PCB 12 so as to move the second end 33 of the board 16 toward the front. The third rotational movement takes place about an axis perpendicular to X. The board 16 is thus moved back in toward the contact portion 37 of the support 14, in a manner opposite to that of the first rotational movement.

The third rotational movement is continued until the first axis 22 is located in one and the same plane (Y, Z) as in the assembled configuration of FIG. 3. The first cutout 32 of the PCB 12 is then located above the notch 54 of the bracket 56.

A fourth rotational movement is then applied to the PCB 12 about the second axis 44 so as to move the second end 33 of the board 16 downward. The first cutout 32 is then lowered so as to be inserted into the notch 54.

The PCB 12 and the support 14 are then in the assembled configuration of FIG. 3, forming the lighting device 10. The LEDs 28 of the PCB 12 are positioned facing the housings 38 of the contact portion 37 of the support 14 so as to transmit light to the output optical system 36.

The insertion of the first cutout 32 into the notch 54 blocks the rotation of the PCB 12 about the axis 44, with respect to the support 14, in a first direction of rotation. This insertion also blocks the translation of the PCB 12 along X, along with its rotation about Y and Z.

Moreover, in the assembled configuration, the rotational portion 50 in the through-hole 30 blocks the translation of the PCB 12 along Y with respect to the support 14.

In the intermediate assembly configuration of FIG. 2, during the second rotational movement along the axis 44, the second longitudinal edge 26 of the board 16 abuts against the free end 64 of the tab 62. When the second rotational movement continues in order to move the first cutout 32 above the bracket 56, the pressure of the board 16 upwardly deforms the tab 62. Next, when the first cutout 32 is inserted into the notch 54, the second cutout 34 of said second longitudinal edge 26 is inserted into the cavity 66 of the tab 62, said tab returning to its initial form.

The insertion of the second cutout 34 into the cavity 66 blocks the rotation of the PCB 12 about X, in a second direction of rotation. Each of the second 32, 54 and third 34, 66 joining elements for joining the PCB 12 to the support 14 therefore blocks said PCB 12 with respect to said support 14 along a different direction of rotation along X.

Optionally, the insertion of the second cutout 34 into the cavity 66 also blocks the translation and/or the rotation of the PCB 12 along X and/or along Y and/or about Z, respectively, with respect to the support 14.

According to the variant mentioned above, the tab 62 is fixed to the contact portion 37 of the support 14 after the insertion of the first cutout 32 into the notch 54, so as to block the PCB 12 in the second direction of rotation. The tab 62 is fixed to the support 14 by means of clip-fastening or screwing, for example.

The assembly method described above requires a relatively small amplitude of movement, in particular regarding the rotations of the PCB 12. The latter may thus be joined to the support 14 even in the case that said support is placed in an environment which is already crowded.

Furthermore, it may be assembled manually by an operator, without special tools and without subjecting the PCB 12 to impacts that could harm the electronic components, in particular the LEDs 28.

The PCB 12 in the assembled configuration is fully blocked in terms of rotation and translation with respect to the support 14, such that it remains in contact with said support in the event of vibrations from the vehicle equipped with the lighting device 10.

The invention claimed is:

1. A lighting device for an automotive vehicle, comprising:

a printed circuit board, comprising one or more electronic components; and a support joined, or that is joinable, to the printed circuit board, wherein the lighting device comprises a first joining device for joining the printed circuit board to the support, said first joining device comprising a first element borne by the printed circuit board and a second element borne by the support, said first joining device permitting the printed circuit board to rotate, with respect to the support, about an axis and perpendicularly to the axis, wherein the first and second element prevent separation from each other when the printed circuit board and the support are rotated from an insertion position translating the printed circuit board along the axis; and a second joining device for joining the printed circuit board to the support, located at a distance from said first joining device, said second joining device comprising: a third element borne by the printed circuit board and located at a distance from the first element; and a fourth element borne by the support and located at a distance from the second element, said second joining device to block the rotations of the printed circuit board with respect to the support, in an assembled configuration of the printed circuit board and the support.

2. The lighting device according to claim 1, wherein the first and second element of said first joining device comprise, respectively, an opening made in the printed circuit board; and a relief of the support, said relief being positioned along the axis; the printed circuit board is pivotable about said relief inserted into said opening.

3. The lighting device according to claim 1, wherein the third and fourth element of said second joining device comprise, respectively: a cutout of an edge of the printed circuit board; and a notch of the support; said cutout is insertable into said notch.

4. The lighting device according to claim 1, wherein:

the printed circuit board is substantially longitudinal in form, comprising first and second opposite ends;

the first element of said first joining device is located adjacent to the first end; and the third element of said second joining device is located adjacent to the second end.

5. The lighting device according to claim 1, wherein, the printed circuit board and the support being in an angular position with respect to the axis corresponding to the assembled configuration, said first joining device permits the printed circuit board to travel with respect to the support, perpendicularly to the axis, by an angle with respect to said assembled configuration, said angle being between 5° and 25°.

6. The lighting device according to claim 1, wherein the respective shapes of the first and second element of said first joining device are to dictate a spatial configuration of the printed circuit board with respect to the support when joining the first and second element.

7. The lighting device according to claim 1, wherein:

said second joining device is configured to block the rotation of the printed circuit board with respect to the support about the axis in a first direction only; and the lighting device additionally comprises a third joining device between the printed circuit board and the support, configured to block the rotation of the printed circuit board with respect to the support about the axis in a second, opposite direction, said third joining device comprising a fifth element borne by the printed circuit board and a sixth element borne by the support.

8. The lighting device according to claim 1, comprising one or more light sources, preferably of semiconductor-based type, fixed to a face of the printed circuit board.

9. A method of assembling the lighting device according to claim 7, comprising:

joining the first and second element of said first joining device to one another in an initial configuration of the printed circuit board with respect to the support; then successively applying first, second and third rotational movements to the printed circuit board with respect to the support, the second rotational movement being effected about the axis, the first and third rotational movements being effected perpendicularly to the axis, and a trajectory of the third element of said second joining device thus circumventing the fourth element of said second joining device; then applying a fourth rotational movement to the printed circuit board with respect to the support, about the axis, in the opposite direction to the second movement, so as to join the third and fourth element of said second joining device, and the printed circuit board and the support thus being in the assembled configuration.

10. The method of assembling the lighting device according to claim 9, wherein:

the application of the first and second rotational movements to the printed circuit board causes an elastic deformation of the sixth element of said third joining device; and the application of the third and fourth rotational movements to the printed circuit board subsequently causes an opposite deformation of the sixth element, and to the joining of the fifth and sixth element of said third joining device.

11. The method of assembling the lighting device according to claim 9, wherein the sixth element of said third joining device is joined to the support after the joining of the third and fourth element of said second joining device.

12. A method of assembling a lighting device for an automotive vehicle, the lighting device including a printed circuit board, including one or more electronic components, and a support joined, or that is joinable, to the printed circuit board, wherein the lighting device includes a first joining device for joining the printed circuit board to the support, said first joining device comprising a first element borne by the printed circuit board and a second element borne by the support, said first joining device permitting the printed circuit board to rotate, with respect to the support, about an axis and perpendicularly to the axis, a second joining device for joining the printed circuit board to the support, located at a distance from said first joining device, said second joining device comprising: a third element borne by the printed circuit board and located at a distance from the first element; and a fourth element borne by the support and located at a distance from the second element, said second joining device to block the rotations of the printed circuit board with respect to the support, in an assembled configuration of the printed circuit board and the support; the method comprising:

joining the first and second element of said first joining device to one another in an initial configuration of the printed circuit board with respect to the support; then successively applying first, second and third rotational movements to the printed circuit board with respect to the support, the second rotational movement being effected about the axis, the first and third rotational movements being effected perpendicularly to the axis, and a trajectory of the third element of said second joining device thus circumventing the fourth element of said second joining device; then applying a fourth rotational movement to the printed circuit board with respect to the support, about the axis, in the opposite direction to the second movement, so as to join the third and fourth element of said second joining device, and the printed circuit board and the support thus being in the assembled configuration.

13. The method of assembling the lighting device according to claim 12, wherein:

said second joining device is configured to block the rotation of the printed circuit board with respect to the support about the axis in a first direction only;

the lighting device additionally comprises a third joining device between the printed circuit board and the support, configured to block the rotation of the printed circuit board with respect to the support about the axis in a second, opposite direction;

said third joining device comprising a fifth element borne by the printed circuit board and a sixth element borne by the support;

the application of the first and second rotational movements to the printed circuit board causes an elastic deformation of the sixth element of said third joining device; and the application of the third and fourth rotational movements to the printed circuit board subsequently causes an opposite deformation of the sixth element, and to the joining of the fifth and sixth element of said third joining device.

14. The method of assembling the lighting device according to claim 12, wherein the sixth element of said third joining device is joined to the support after the joining of the third and fourth element of said second joining device.

15. The lighting device according to claim 5, wherein said angle is 20°.

* * * * *